US005904249A

United States Patent [19]

Roulin et al.

[11] Patent Number: 5,904,249

[45] Date of Patent: May 18, 1999

[54] BLISTER PACK

[75] Inventors: Monique Roulin, Aesch, Switzerland; Manfred Gerber, Singen, Germany; Heinz Oster, Feuerthalen, Switzerland

[73] Assignee: Alusuisse Technology & Management Ltd., Switzerland

[21] Appl. No.: 09/088,479

[22] Filed: Jun. 1, 1998

Related U.S. Application Data

[60] Continuation of application No. 08/855,221, May 13, 1997, which is a division of application No. 08/548,338, Nov. 1, 1995, Pat. No. 5,695,063.

[51] Int. Cl.[6] ..... B65D 83/04

[52] U.S. Cl. ..... 206/531; 206/539; 206/469

[58] Field of Search ..... 206/528, 531, 206/532, 534, 538, 467, 469, 461, 471

[56] References Cited

U.S. PATENT DOCUMENTS 4,911,304 3/1990 Bunin ..... 206/531

FOREIGN PATENT DOCUMENTS 29 19 713 11/1980 Germany ..... 206/531

*Primary Examiner*—Paul T. Sewell
*Assistant Examiner*—Nhan T. Lam
*Attorney, Agent, or Firm*—Bachman & LaPointe, P.C.

[57] ABSTRACT

Blister pack for pharmaceuticals containing a base with a plurality of recesses which are surrounded by a shoulder. A lid foil is attached to the shoulders. Removable contents such as a tablet, capsules or ampoules reside in each of the recesses and may be removed therefrom by pressing the recess in question and penetrating the lid foil or by removing the lid foil over the recess. The blister pack features a movable lid or a clamping element which covers at least one recess, and the clamping element is arranged in such a manner that it can be slid over the lid foil, and the clamping element closes off again at least one recess where the lid foil has been penetrated or peeled back, or closed again at least one recess which on filling was left unfilled and without lid.

14 Claims, 5 Drawing Sheets

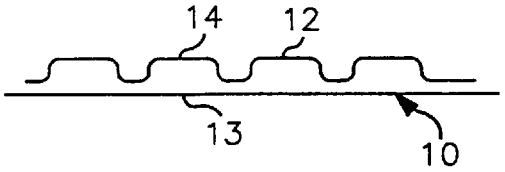
FIG. IC
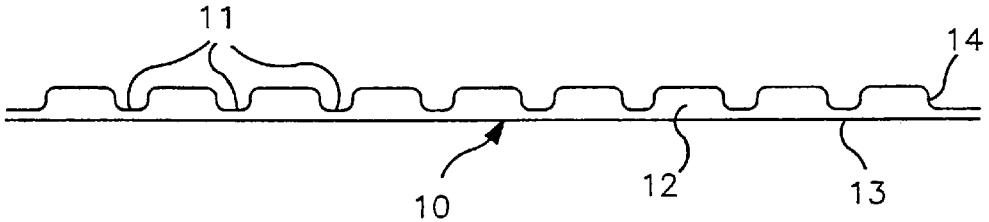
FIG. IB
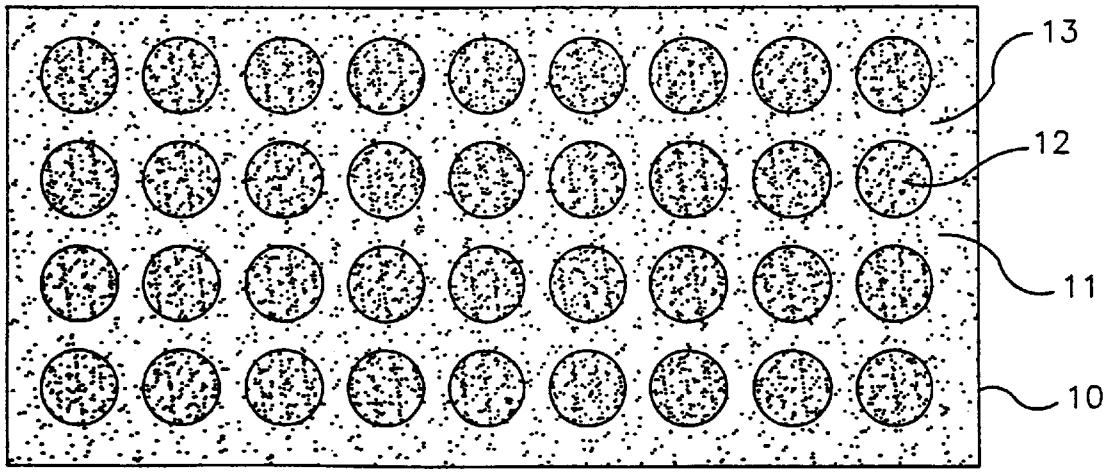
FIG. IA

BLISTER PACK

This is a Continuation of application Ser. No. 08/855,221, filed May 13, 1997, which in turn is a Division of application Ser. No. 08/548,338, filed Nov. 1, 1995, now U.S. Pat. No. 5,695,063.

BACKGROUND OF THE INVENTION

The present invention relates to blister packs for pharmaceuticals having a base with a plurality of recesses that are surrounded by a shoulder and a lid foil attached to the shoulder, where removable contents are accommodated in the recesses and may be removed therefrom by pressing on the recess in question making the contents penetrate the lid foil, or by removing the lid foil over the recess, and where the blister pack features a moveable lid that covers the recess, and the lid is arranged such that it can slide over the lid foil.

It is known to fill the bases of blister packs, in particular push-through packs, with contents, to cover the whole of base with a lid material, and to seal the lid material in place. The blister pack is characterized by way of a single or, in particular, by a plurality of single compartments that accommodate e.g. solid items, shaped solid preparations or pharmaceutical products such as tablets or dragées. If a single item e.g. a tablet is to be removed from a blister pack, the recess in the base is pressed in and the tablet is pushed through the lid material.

The present invention embraces various kinds of blister packs. This includes e.g. the so-called push-through packs. Push-through packs are e.g. such that the lid material is of aluminum foil or an aluminum foil laminate. Aluminum foil is a preferred material for the lids on blister packs as the thickness of the material employed requires relatively little force for it to rupture. Consequently, the energy for penetration is low and the aluminum exhibits essentially no elasticity. As a rule the base of the blister pack is made of plastic, for example plastics such as PVC, polyamides, polyolefins, polyesters and laminates or multi-layered materials containing at least one of these materials and, if desired, also containing an aluminum foil. Other blister packs feature a base which is covered by a lid foil. The lid foil may cover the whole of the base area and is usefully provided with a line of weakness in the region of each recess, or each recess may be covered with an individual lid segment. Within the line of weakness or on each lid segment may be a tab for gripping which enables the individual recess to be exposed by peeling back the lid segment. As a rule, the base and the lid are of the above mentioned materials, whereby plastic laminates may also be employed for the lid materials.

Such blister packs have found widespread use in the field of health care and for distribution of sweets such as pastilles and bonbons. Because of the possibility they offer to store sensitive contents carefully, and because of the ease with which the contents can be removed from them, such blister packs are now regarded as indispensable in daily life. With increasing endeavors being made to cut costs in health care, attempts are being made to keep the blister packs as small as possible and to limit the number of different formulations. This can mean that a pharmaceutical formulation is produced at only one concentration level and it may happen that not one whole tablet or dragée has to be taken but, e.g. according to the weight or stage of the illness of a patient, only a partial dose e.g. half of a tablet or a dragée has to be administered. It is also conceivable for one recess to accommodate two or more tablets, dragées, capsules, ampoules and the like and for only a fraction of the contents to be consumed at a given time. Returning e.g. the rest of a tablet divided into two parts to the recess is not straightforward in the case of the normal blister packs, and the recess can not be closed off again as the lid material over the recess has been torn, burst or peeled off.

SUMMARY OF THE INVENTION

The object of the present invention is to propose blister packs which enable unused amounts such a e.g. tablets or parts thereof or a dragée or one or more dragées, capsules or ampoules to be stored safely i.e. against loss or protected from moisture and dirt until consumption.

That object is achieved by way of the invention in that a moveable clamping element is provided over the lid foil surface as a lid, and the clamping element has a lid element which covers at least one opened recess, or the clamping element has two lid elements that are joined together by struts at one or both ends, and one of these two lid elements covers at least one opened recess, or both lid elements each cover at least one opened recess, or at least one opposite lying, opened recess, and the clamping type element can be displaced along the blister pack in a sliding manner, and the clamping type element closes off at least one recess having a ruptured or removed lid foil or at least one recess which was empty and uncovered at first filling.

BRIEF DESCRIPTION OF THE DRAWINGS

The present invention may be more readily understandable from a consideration of the accompanying drawings, wherein:

FIG. 1*a* shows a plan view of a normally used blister pack, FIG. 1*b* shows a longitudinal section through the blister pack of FIG. 1*a,* and FIG. 1*c* shows a cross-section through the blister pack of FIG. 1*a;*

DETAILED DESCRIPTION OF PREFERRED EMBODIMENTS

Figure 2C:
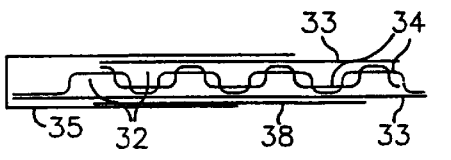
FIG. 2*a* shows a plan view of a blister pack of the present invention.
FIG. 2*b* shows a longitudinal section through the blister pack of FIG. 2*a* along line 2*b*—2*b* of FIG. 2*a,* FIG. 2*c* shows a cross-section along line 2*c*—2*c* of FIG. 2*a,* and FIG. 2*d* shows a cross-section along line 2*d*—2*d* of FIG. 2*a;*

The base of the present blister packs may be embossed, deep drawn or vacuum shaped bases out of plastic, plastic laminates, plastic/paper laminates or plastic/metal foil laminates. Suitable plastics for base materials are e.g. films and film laminates containing PVC, polyamides, polyolefins, polyesters, polycarbonates etc. The bases may also feature a barrier layer against gases and vapours. Such barrier layers may e.g. be a metal foil such as an aluminum foil embedded in a plastic laminate or, usefully, ceramic layers or metallic layers embedded between two plastic layers. Ceramic layers may be produced e.g. by evaporating metals, oxides or nitrides of aluminum, silicon and other metals and semi-metals in vacuum and depositing the substances on a plastic substrate. These methods are e.g. known as chemical vapor deposition and physical vapor deposition or sputtering. The ceramic layers may by preference contain aluminum oxides or silicon oxides or may be mixtures of various oxides, if desired also mixed with metals such as e.g. silicon or aluminum. Metal layers may be created by evaporating metals in vacuum and depositing the metals on a plastic substrate; aluminum layers may be mentioned here by way of example. The plastic substrate may be a plastic film or a plastic base made of the above mentioned plastics. The lid material for the push-through pack is, as a rule, an aluminum foil or a laminate containing aluminum foil. It has also been proposed to replace the aluminum foil with a plastic that exhibits low elasticity and poor stretching properties. Such plastics are obtained e.g. when large amounts of filler materials are added to the plastic. This last mentioned version would make it possible to obtain easily sorted waste material i.e. no mixture of metal and plastics. Plastics and plastic laminates could also be employed for blister packs with peel back lid material. The bases usually feature between 6 and 30 recesses in the form of cups or dishes. The recesses are surrounded by a shoulder, said shoulders together forming an interconnected flat plane. The bases are prepared e.g. as an endless strip with the contents in the recesses and brought together with the lid material, in particular in lid foil form, likewise in the form of an endless strip. The lid foil covers the base completely and e.g. by sealing or adhesive bonding is joined to the base at the shoulders. The lid foil may be sealed or adhesively bonded to the shoulders over the whole area or, by choosing a special sealing tool or bonding pattern for the purpose, this sealing or bonding may be only partial. Next, the endless strip of lidded base part may be cut to the desired size . This may be performed e.g. using a stamping tool. At the same time, the blister pack may be give outer contours, or it is possible to provide weaknesses in the lid material or the base in order to allow the blister pack to be bent or to create lid segments, making easy removal of the lid segment and removal of the contents possible.

Useful, is a blister pack according to the invention where the base and the lid foil are joined together and the blister pack folded along a line, or two blister packs lie one on top of the other such that two base halves touch each other and two lid foil halves form the outside, and a clamping element comprising two tongues connected by a strut overlap both base halves and the clamping element can be moved, by siding or lifting, over the lid foil surfaces and the breadth of one or both of the tongues is capable of covering at least one opened recess, or the clamping element comprises two lid elements that are joined at the ends by struts and each lid element is of a width that at least corresponds to the breadth of one recess, and each lid element on each lid foil half is capable of covering at least one opened recess, and the clamping element can be displaced along the length or breadth of the blister pack in a sliding manner.

Also useful is a blister pack according to the present invention the base of which features two parallel sides and the base is covered with the lid foil and, a clamping element which covers at least one or more recesses, is positioned over the lid foils in such a manner that it can be moved by sliding, and the clamping element clasps over or engages both parallel sides of the blister pack in the form of a ring.

Also useful is a blister pack according to the present invention in which the base and the lid foils are engaged by a clamping element comprising a strut and tongues on both sides of the strut, and one tongue, acting as a lid element of the clamping element, covers at least one recess on the lid foil side of the blister pack and the other tongue on the base side engages between at least two neighboring recesses or the tongue engages a recess on both sides.

Finally, a useful blister pack according to the present invention is such that the pack features a round periphery and the recesses in the base are arranged in one or more concentric circles, and the base can be rotated in the clamping element comprising lid and clamping or clasping ring, and the lid features at least one opening through which the contents can be expressed.

A clamping element covers at least one recess. A clamping element may also cover two, three or four recesses at the same time. For example, tongues may cover over one of two etc. whole rows or a part of one, two etc. rows of recesses i.e. for example two, three, four etc. recesses. Lid elements may cover one, two etc. whole rows of recesses each having e.g. one, two, three, four etc. recesses. Usefully the maximum number of recesses covered by a clamping element corresponds to the number of recesses in the blister pack minus one.

The present invention is described in greater detail with the aid of exemplified embodiments in FIGS. 1–5.

FIG. 1 shows a blister pack or push-through pack such as are normally used today for packaging pharmaceutical products such as tablets or dragées. Shown in FIG. 1*a* is a plan view of a blister pack 10 in which the lid foil 13 is joined at the shoulders 11 to the base 14. Indicated are the recesses 12 which are covered by the lid foil. FIG. 1*b* shows a longitudinal section through the blister pack 10. The base 14 with recesses 12 makes contact with the lid foil 13 at the shoulders 11. In the region of the shoulders 11 the lid foil is joined to the base e.g. by sealing or adhesive bonding (sealing/adhesive not shown). FIG. 1*c* shows a cross-section through the blister pack 10 with its base 14, lid foil 13 and the recesses 12 formed by them.

Figure 2D:
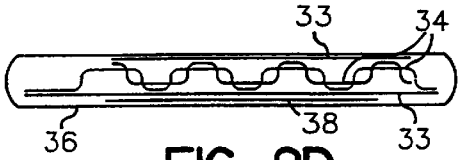
Figure 2B:
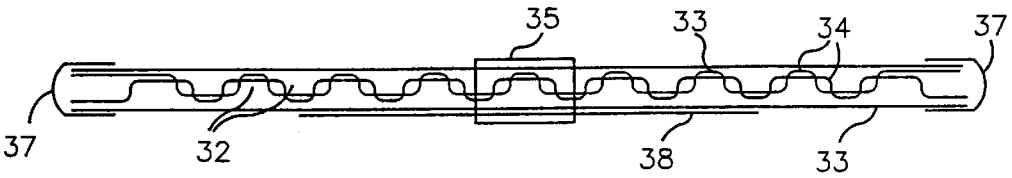
Figure 2A:
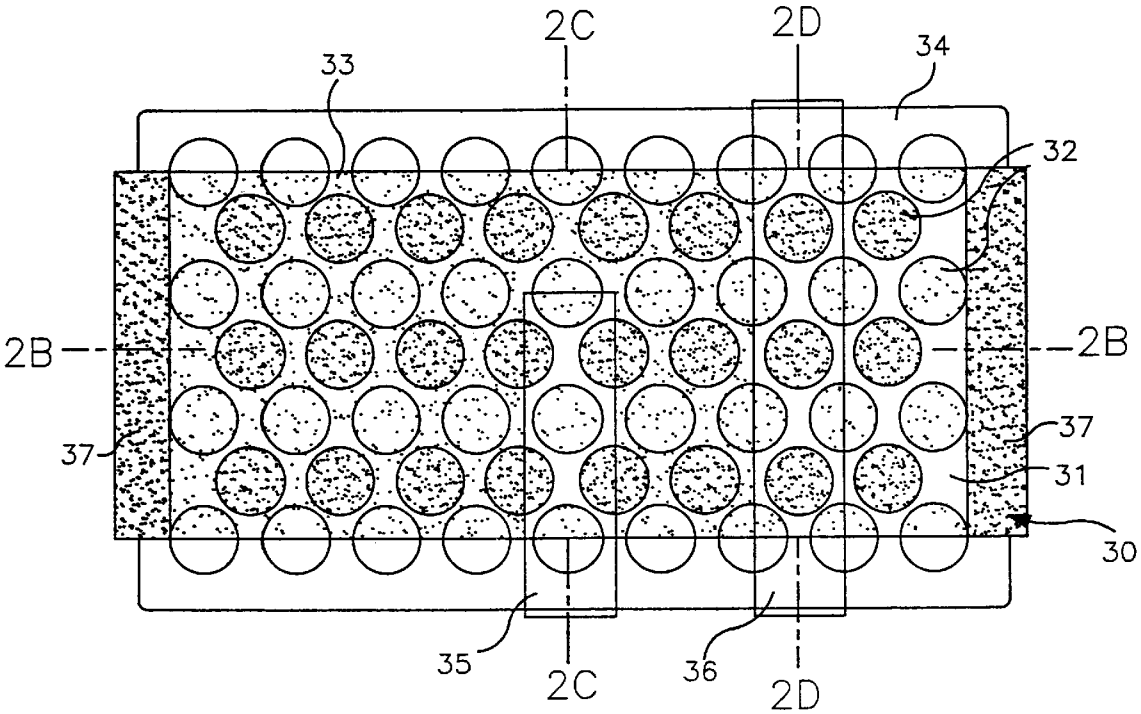
Figure 3C:
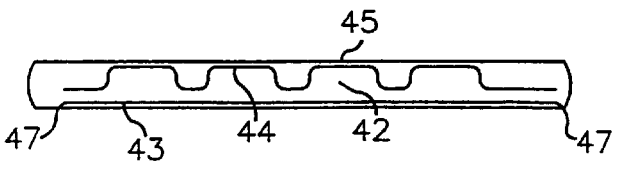
FIG. 3*c* shows a cross-section along line 3*c*—3*c* of FIG. 3*a;*
Figure 3B:
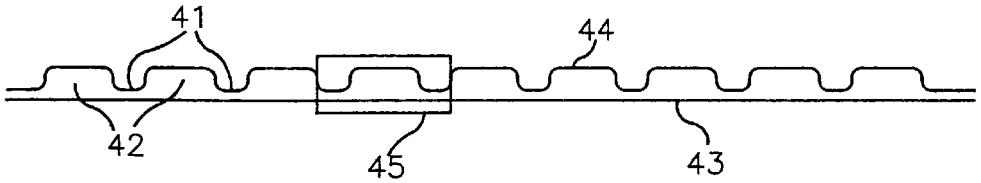
FIG. 3*b* shows a longitudinal section through the blister pack of FIG. 3*a*.
Figure 3A:
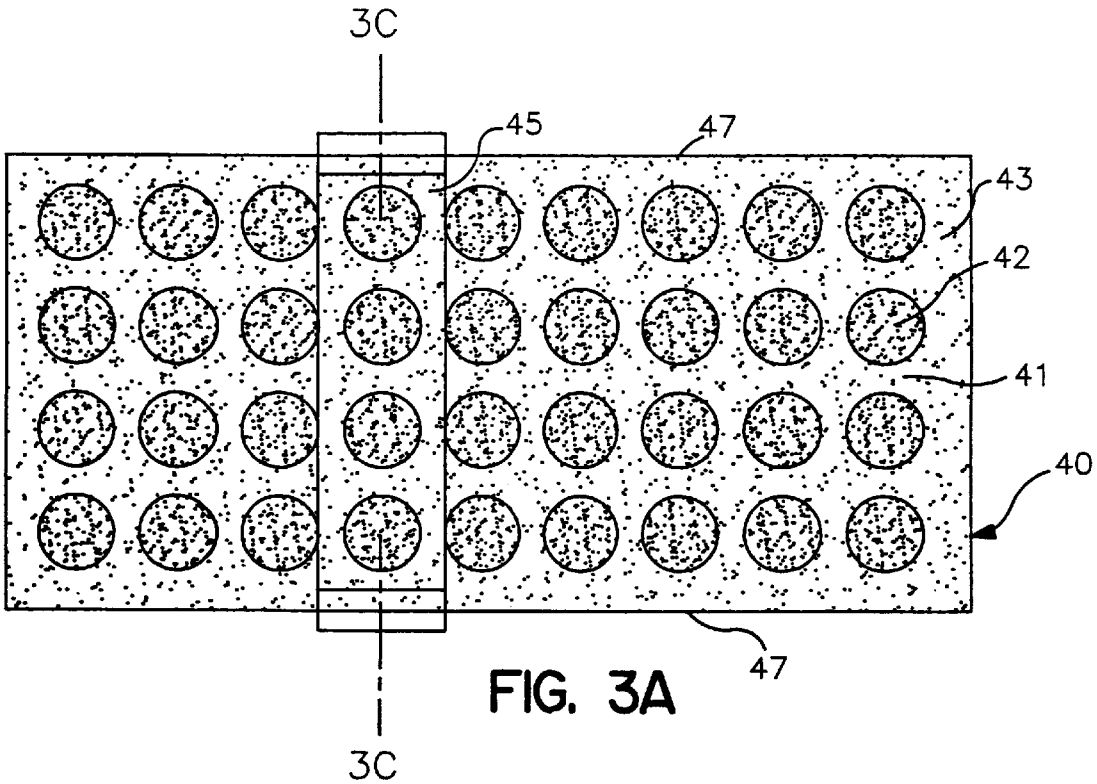
FIG. 3*a* shows a plan view of another embodiment of the blister pack of the present invention.
Figure 4C:
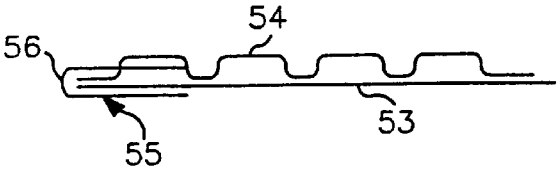
FIG. 4*c* shows a cross-section through the blister pack of FIG. 4*a,* and FIG. 4*d* shows a clamping element.
Figure 4D:
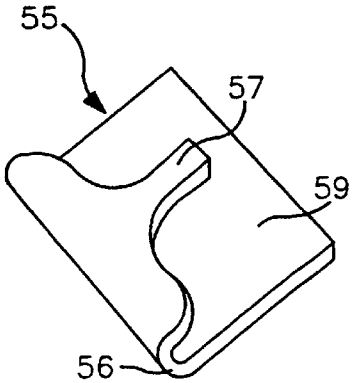
FIG. 4*a* shows a plan view of another embodiment of the blister pack of the present invention.
FIG. 4*b* shows a longitudinal section through the blister pack of FIG. 4*a*.
Figure 4B:
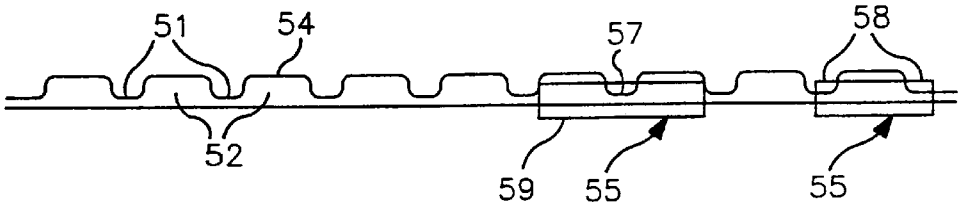
Figure 4A:
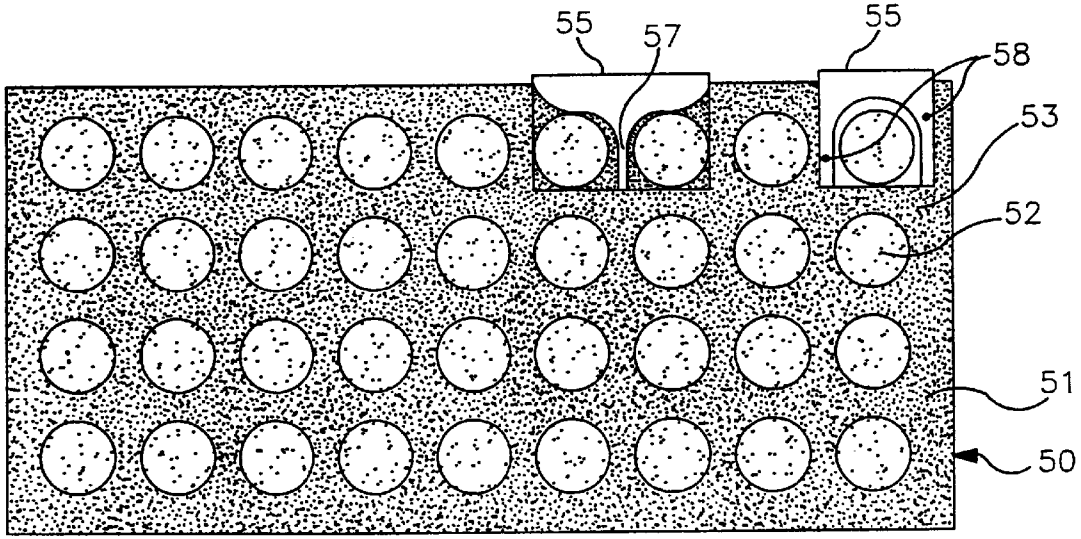

FIG. 2*a* shows a plan view of another version of the blister pack according to the invention. The blister pack 30 features two bases 34 which are covered by lid foil 33. Both bases 34 are laid on each other in such a manner that the recesses 32 in both bases interlock, and the recesses 32 in one base abuts against the shoulder region 31 of the other base; as a result both bases 34 lie against each other. The lid foils 33 of the two bases 34 face each other. In order that both bases 34 do not fall away from each other, an adhesive join 37 is provided e.g. in the form of a an adhesive strip or, in a further version, in the form of a plastic clamp or metal clamp or the like. By opening one of these adhesive joins 37 the pack can be easily opened up. The blister pack according to FIG. 2 also features a clamping element 35 or a ring-shaped clamping element 36. Both of these clamping elements represent alternative versions. Clamping element 35 comprises a strut and two tongues. The height of the strut is selected such that both tongues on the clamping element slide over both lid foils 33. FIG. 2*b* shows a longitudinal cross-section through the blister pack in FIG. 2*a* with both bases 34 engaging each other via the recesses 32, both lid foils 33, adhesive join 37 joining both halves together and the clamping element 35. Also shown is an accompanying note 38 or another form of information about the product, which may be held securely in place by the clamping element 35 or the ring-shaped clamping element 36 (not shown here). FIG. 2*c* shows a cross-section through a blister pack 30 from FIG. 2*a* along line 2*c*—2*c* in FIG. 2*a*. FIG. 2*d* shows a cross-section along line 2*d*—2*d* in FIG. 2*a*. FIG. 2*c* shows both base halves 34 with interlocking recesses 32 and lid foils 33. Clamping element 35 may e.g. feature a strut and two tongues formed on these. The clamping element 35 partially overlaps both halves of the blister pack from one side. The clamping element 35 may engage both halves with a spring action that may be created e.g. by spreading apart a clamping element made of elastic material, for example thermoplastic or elastic plastics; instead of a connecting strut a spring under tension may provide both tongues of the clamping element with the desired elastic force. The length of the tongues is usefully chosen such that the recesses 32 at the edge on both lid foil sides are covered. FIG. 2*d,* a section along the line 2*d*—2*d* in FIG. 2*a,* shows the alternative version with the ring-shaped clamping element 36. Clamping element 36 overlaps the whole blister pack across its width and clamping element 36 is e.g. rectangular in cross-section. Also the ring-shaped clamping element 36 slides over the lower and upper lid foils 33, and the clamping element 35, as with clamping element 36, is chosen to be at least somewhat larger in breadth than the diameter of a recess. The clamping element 35 can therefore be slid or changed from one side to the other, and a recess 32 that has already been opened can be closed off again. The ring-shaped clamping element 36 can be pushed back and forward and its breadth chosen such that it is at least somewhat larger than the diameter of a recess. By sliding the clamping element 36 along the side of the blister pack 30 it is possible to cover over again any recess that has been opened, and with that hold back any residual contents in the recess. FIG. 3*a* shows a further version of a blister pack according to the invention. The blister pack 40 features shoulders 41 via which the lid foil is joined to the base 44 and forms recesses 42. A clamping element 45, in the form of a ring, spans the blister pack 40. The size of the cover 45 is chosen such that one side slides over the lid foil 43 and the other side slides over the limits of the recesses 42 in the base 44. FIG. 3*b* shows a longitudinal section, FIG. 3*c* a section along line 3*c*—3*c* in FIG. 3*a*. The breadth of the clamping element 45 is chosen such that a recess is safely covered and e.g. also the shoulder region on both sides of the recess 42. This ensures safe retention of the contents in an opened recess 42.

FIG. 4 shows a blister pack 50 with shoulders 51 and recesses 52 in the base 54 which is covered over by the lid foil 53. FIG. 4*a* is a plan view of the blister pack 50 and in FIG. 4*b,* a longitudinal section through the blister pack 50, two alternative versions of clamping elements 55 are shown. These clamping elements may e.g. be of plastic. The clamping element 55 features a strut 56 from which two tongues 57 and 59 or a tongue 57 and a double tongue 58 project out. The tongues press together in an elastic manner or by means of spring force. FIG. 4*c* shows the blister pack 50 sectioned across its breadth with one clamping element 55 displaced. FIG. 4*d* shows by way of example a clamping element 55 which features a strut 56 and a tongue 57. The breadth of the tongue is 57 is chosen such that it can engage between two recesses 52 in the base 54 and its width is usefully chosen such that the breadth of the tongue corresponds to the smallest distance between two recesses. The clamping element sits tightly between two recesses 52 due to the action of the tongue 57. On the clamping element opposite the tongue 57 is a further sheet-like tongue 59 which forms a lid that can be slid e.g. over two recesses. Also to be seen in FIG. 4*a* is a further clamping element 55 which, instead of a tongue 57, features a double tongue 58 that engages a recess 52 in the base 54 on two sides and can therefore not be displaced sideways. Opposite the tongue 58 is a sheet-like tongue which is able to cover at least two recesses 52. The clamping elements 55 may be drawn away in one direction from the blister pack 50 and give access to the recess 52. In other words, clamping elements 55 may be pushed onto the blister pack as slides or cursors, in particular self-clamping onto the blister pack.

Figure 5C:
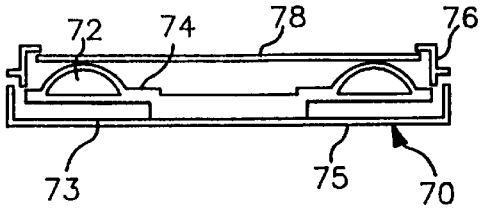
FIG. 5*a* shows a plan view of a blister pack of the present invention which is round in plan view.
FIG. 5*b* shows a section through the plan view of FIG. 5*a,* and FIG. 5*c* shows a cross-section through the blister pack of FIG. 5*a.*
Figure 5B:
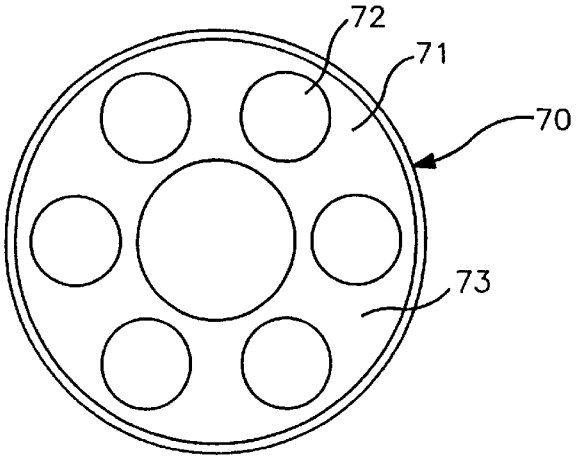
Figure 5A:
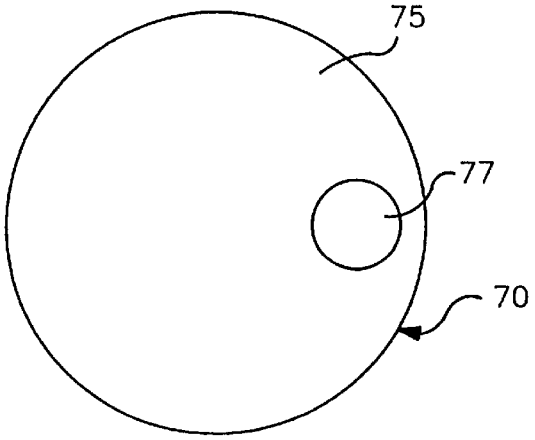

FIG. 5 shows a blister pack 70 which is round in plan view. Shown in FIG. 5*a* is the blister pack 70 in plan view with one recess 77, here by way of example a round hole in the lid 75. As shown in FIG. 5*b,* a section through the plan view of the blister pack 70 and FIG. 5*c,* a cross-section through the pack 70, a plurality of recesses 72 is arranged in a circle. The base 74 with a plurality of compartments 72 is covered by a lid foil 73. The lid features an opening 77, which is shown in FIG. 5*a* by way of example as a circular hole. The position of the opening 77 in the lid 75 is situated exactly in the same mid-position as the recesses 72, and the diameter of the opening 77 is approximately the same as the diameter of a recess 72. The filled base 74 with lid foil 73 is placed in the lid 75. The lid 75 features an edge 74 and, in order to secure the base 74, e.g. a clamping or clasping ring 76 forms a clamping element in the lid 75. The clamping ring 76 may feature an edge or a groove that is directed inwards, which holds an accompanying leaflet 78 which, as the base 74, is inserted into the lid 75. As, in the case of the clamping ring 76, it concerns a ring with a large opening in the center, the accompanying leaflet can be easily removed, whereupon the recesses 72 are open from below and their contents can be easily removed via the opening 77 by pushing them through the lid foil 73. By rotating the lid 75 against the base 74, the pack may be securely closed, thus preventing the rest of the contents from falling out of the base 74. An empty recess 72 can be refilled with residual contents and, by rotating the lid 77, be closed off again.

For reasons of clarity the contents were not shown in the drawings. It is, however, obvious that in each case the contents are situated in the recesses. Contents coming into question may be e.g. tablets, dragées, pills, capsules, ampoules, also bonbons, lozenges, and tablets for chewing etc. and not excluded is that the blister packs according to the invention could also be used as packaging for technical articles such as small and very small items or spare parts for machines and equipment.

We claim:

1. Blister packs having a base with a plurality of recesses in a plurality of rows, a shoulder surrounding the recesses, and a lid foil attached to the shoulder, where removable contents are accommodated in the recesses and are removed therefrom by at least one of (1) pressing on a recess, and making the contents penetrate the lid foil, and (2) by removing the lid foil over the recess, including two blister packs which lie one on top of the other such that two base halves touch each other and two lid foil halves form the outside of the blister pack, wherein the blister pack features at least one clamping element comprising two tongues connected by a strut, said tongues overlapping both base halves, wherein the clamping element is operative to move over the lid foil surfaces and at least one tongue is operative to cover at least one opened recess, and wherein the breadth of at least one of said tongues is larger than the diameter of a recess, and wherein the area of the clamping element is of an expanse that it covers less than the total number of recesses in any position and wherein the clamping element covers a maximum of one row of recesses in the closed position.

2. Blister pack according to claim 1, wherein the recesses of both blister packs interlock.

3. Blister pack according to claim 2, wherein the recesses in the base of one blister pack abut against the shoulder of the other blister pack.

4. Blister pack according to claim 1, wherein the lid foils of the two blister packs face each other.

5. Blister pack according to claim 1, wherein the two blister packs are joined together by an openable adhesive join.

6. Blister pack according to claim 5, wherein said adhesive join is an adhesive strip.

7. Blister pack according to claim 1, wherein the two blister packs are joined together by clamp.

8. Blister pack according to claim 1, wherein said clamping element is generally rectangular in shape.

9. Blister pack according to claim 1, wherein said clamping element includes a strut and two tongues, wherein both tongues are operative to slide over both lid foils.

10. Blister pack according to claim 9, wherein said clamping element partially overlaps both halves of the blister pack.

11. Blister pack according to claim 9, wherein said clamping element is a generally rectangular shaped clamping element.

12. Blister pack according to claim 11, wherein said clamping element overlaps the blister pack.

13. Blister pack according to claim 9, wherein the breadth of the tongues is larger than the diameter of a recess.

14. Blister pack according to claim 1, including an information sheet held in place by said clamping element.

* * * * *